US011572898B2

(12) United States Patent
Lin et al.

(10) Patent No.: US 11,572,898 B2
(45) Date of Patent: Feb. 7, 2023

(54) LEVERING DEVICE

(71) Applicant: NAN YANG WATER SCIENTIFIC TECHNOLOGY CO., LTD, Yilan (TW)

(72) Inventors: Jui-Yu Lin, Yilan (TW); Po-Yu Chiang, Yilan (TW); Hsi Chen, Yilan (TW)

(73) Assignee: NAN YANG WATER SCIENTIFIC TECHNOLOGY CO., LTD, Yilan (TW)

( * ) Notice: Subject to any disclaimer, the term of this patent is extended or adjusted under 35 U.S.C. 154(b) by 0 days.

(21) Appl. No.: 17/486,156

(22) Filed: Sep. 27, 2021

(65) Prior Publication Data

US 2022/0010814 A1 Jan. 13, 2022

Related U.S. Application Data

(62) Division of application No. 16/527,549, filed on Jul. 31, 2019, now abandoned.

(30) Foreign Application Priority Data

Aug. 1, 2018 (TW) ..... 107210525

(51) Int. Cl.
*F04D 29/62* (2006.01)
*F04D 31/00* (2006.01)
(Continued)

(52) U.S. Cl.
CPC ..... *F04D 31/00* (2013.01); *F03B 7/003* (2013.01); *F04D 5/00* (2013.01); *F04D 5/007* (2013.01);
(Continued)

(58) Field of Classification Search
CPC . F04D 31/00; F04D 5/00; F04D 5/002; F04D 5/007; F04D 29/046; F04D 29/0462; F04D 29/049; F04D 29/626
See application file for complete search history.

(56) References Cited

U.S. PATENT DOCUMENTS 1,435,278 A * 11/1922 Campbell ..... B25B 27/062 29/263
1,473,075 A * 11/1923 Bates ..... B25B 27/062 29/261

(Continued)

*Primary Examiner* — Courtney D Heinle
*Assistant Examiner* — Andrew J Marien
(74) *Attorney, Agent, or Firm* — Muncy, Geissler, Olds & Lowe, P.C.

(57) ABSTRACT

A levering device includes a coupling block, a gripper, an operating rod, and a constraint sleeve. The coupling block includes a coupling chamber, two guide slots in communication with the coupling chamber, an extension rod, and an axial hole axially cut through the extension rod in communication with the coupling chamber. The operating rod being axially movably inserted through the axial hole into a bearing chamber of a housing of a motor-driven water lifting device to stop against respective one end of a wheel axle of the motor-driven water lifting device. The gripper is attachable to the two guide slots of the coupling block and includes two gripper blocks and two claw bars respectively connected to the gripper blocks. The constraint sleeve is sleeved onto the coupling block to stop the two claw bars in the respective the guide slots.

3 Claims, 12 Drawing Sheets

(51) Int. Cl.

| | |
|---|---|
| ***F04D 5/00*** | (2006.01) |
| ***F03B 7/00*** | (2006.01) |
| ***F04D 29/04*** | (2006.01) |
| ***F04D 29/046*** | (2006.01) |
| *F04D 29/22* | (2006.01) |

(52) U.S. Cl.
CPC ..... *F04D 29/04* (2013.01); *F04D 29/046* (2013.01); *F04D 29/0462* (2013.01); *F04D 29/626* (2013.01); *F04D 29/2261* (2013.01)

(56) References Cited

U.S. PATENT DOCUMENTS

| | | | | | |
|---|---|---|---|---|---|
| 1,782,037 | A | * | 11/1930 | Grebenstein | B25B 27/023 29/261 |
| 1,801,553 | A | | 4/1931 | Heimburger | |
| 1,974,476 | A | | 9/1934 | Wahl | |
| 2,157,409 | A | | 5/1939 | Helfrecht | |
| 2,278,397 | A | | 3/1942 | Scheibe et al. | |
| 2,360,781 | A | * | 10/1944 | McGinnis | B25B 27/023 29/261 |
| 3,303,788 | A | | 2/1967 | Mieville | |
| 4,084,305 | A | * | 4/1978 | Chang | B25B 27/023 29/261 |
| 4,174,558 | A | * | 11/1979 | Dombrowski | B25B 27/023 29/259 |
| 4,682,395 | A | * | 7/1987 | Klann | B25B 27/062 29/261 |
| 4,852,235 | A | * | 8/1989 | Trease | B25B 27/062 29/263 |
| 4,977,661 | A | * | 12/1990 | Wood | B25B 27/062 29/261 |
| D359,670 | S | * | 6/1995 | Cutter | D8/51 |
| 5,779,439 | A | | 7/1998 | Dufour | |
| 6,092,279 | A | * | 7/2000 | Shoup | B25B 27/062 29/259 |
| 6,671,959 | B1 | * | 1/2004 | Skaggs | B25B 27/062 29/256 |
| 2001/0033791 | A1 | | 10/2001 | Dalton et al. | |
| 2005/0232789 | A1 | | 10/2005 | Hinz et al. | |
| 2009/0016919 | A1 | | 1/2009 | Mitchell | |

* cited by examiner

LEVERING DEVICE

This application is a divisional application of U.S. patent application Ser. No. 16/527,549, which was filed on Jul. 31, 2019 and which claims the priority benefit of Taiwan patent application number 107210525, filed on Aug. 1, 2018.

BACKGROUND OF THE INVENTION

1. Field of the Invention

The present invention relates to contact lens processing technology and more particularly, to a motor-driven water lifting device, which has a water supply pipe disposed at the periphery of the housing of the water lifting device for guiding water through the accommodation chamber in the housing, an air valve mounted in an air inlet hole on the housing of the water lifting device for guiding an external gas such as air, carbon dioxide, hydrogen, oxygen or ozone gas into the accommodation chamber to mix with the intake water so that a bubble water can be produced for cleaning various objects to achieve an optimized cleaning effect.

2. Description of the Related Art

In a conventional motor-based water supply and lifting device, a water supply pipe and a water lifting device are provided at one side of a motor. To ensure smooth rotating of the water-lifting wheel of the water lifting device, axle bearings are used to support the wheel axle of the water-lifting wheel. However, the axle bearings of the conventional water-lifting wheel is packaged inside the water lifting device. When the motor is started up to rotate the wheel axle of the water-lifting wheel, the vanes are rotated with the water-lifting wheel to lift water. The water-lifting wheel, the wheel axle and the axle bearings inside the water lifting device are in a state of high-intensity operation for a long time, which is easy to cause wear and failure of the axle bearings, resulting in unsmooth rotation of the water lifting device and low performance of the motor. However, since the axle bearings are hidden in the depth of the inside of the water lifting device and it is almost impossible to replace the axle bearings, when the bearing of the water purging device fails, it represents the reimbursement of the water motor, and the water lifting device needs to be replaced as a whole, which is quite inconsistent with economic benefits.

Further, the water supply pipe is disposed at the periphery of the housing of the water lifting device, having a water inlet at one end thereof and a water outlet at an opposite end thereof. The water inlet is connected to a water source for guiding water into the inside of the housing of the water lifting device. The water outlet is connected to a water nozzle or water trough for guiding water out of the housing of the water lifting device. When the water outlet is connected to a high-pressure outlet nozzle for cleaning foods, when the water molecules of the output water are not easy to penetrate into the food to clean, and the pesticide, bacteria and toxic substances cannot be effectively removed. Therefore, the present invention specifically redesigns the water supply pipe, so that the water molecules can be fined, and various objects can be cleaned to achieve an optimized cleaning effect.

SUMMARY OF THE INVENTION

It is an object of the present invention to provide a levering device is for use to remove axle bearings from a wheel axle of a motor-driven water lifting device having a housing including an accommodation chamber and comprises a coupling block, a gripper, an operating rod, and a constraint sleeve. The coupling block is attachable to arched bearing holder plates at one side of the housing of the motor-driven water lifting device. The coupling block comprises a coupling chamber for receiving the arched bearing holder plates at one side of the housing, two guide slots cut through a peripheral wall thereof in communication with the coupling chamber and respectively disposed corresponding to channels between the two arched bearing holder plates at one side of the housing, an extension rod axially extended from one side thereof opposite to the accommodation chamber, and an axial hole axially cut through the extension rod in communication with the coupling chamber. The operating rod being axially movably inserted through the axial hole into a bearing chamber of the housing to stop against respective one end of the wheel axle. The gripper being attachable to the two guide slots of the coupling block. The gripper comprising two gripper blocks respectively disposed at two opposite sides relative to the extension rod of the coupling block outside the guide slots and two claw bars respectively connected to the gripper blocks and respectively terminating in a claw for catching the axle bearings. The constraint sleeve being sleeved onto the coupling block to stop the two claw bars in the respective the guide slots.

Advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
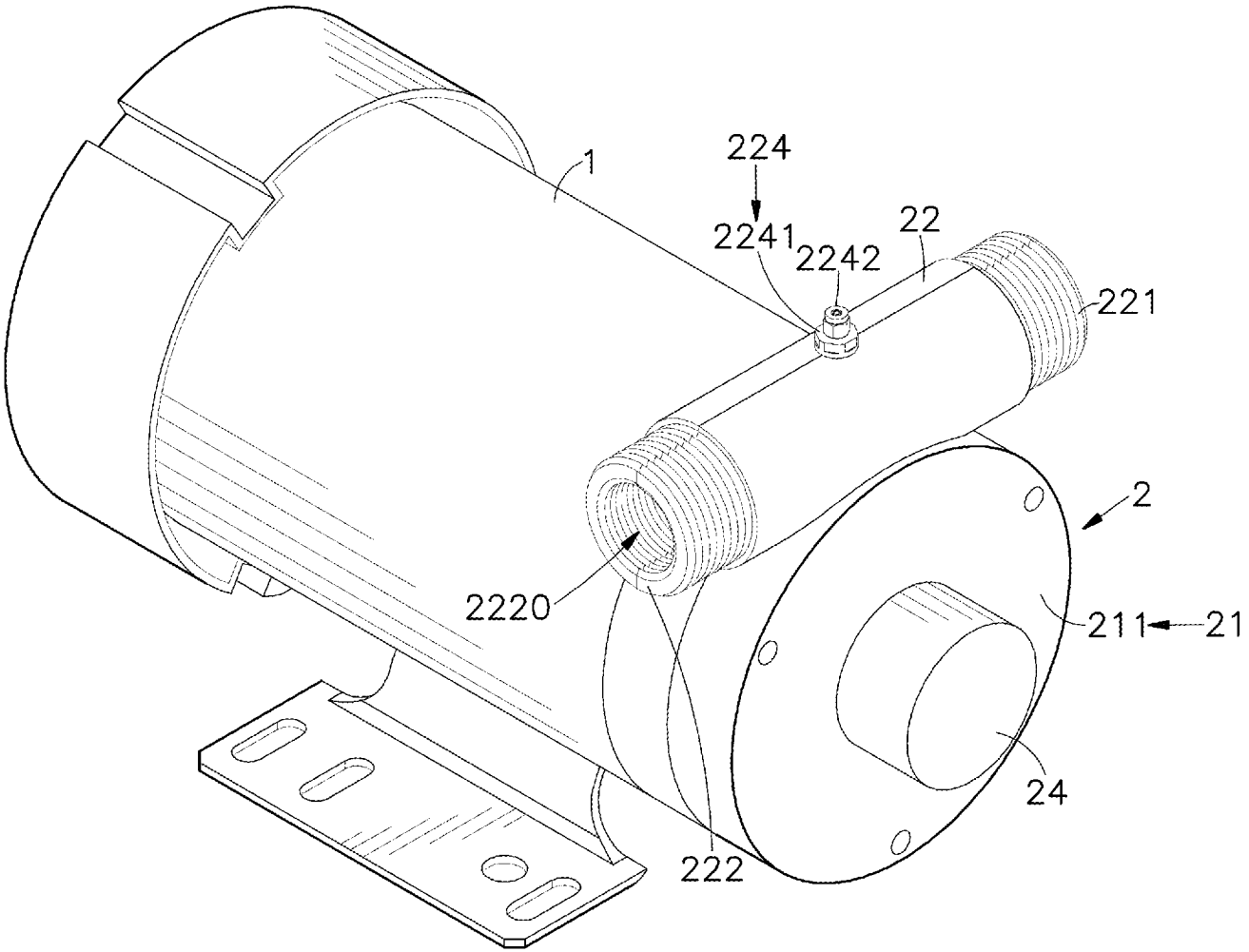
FIG. 1 is an oblique top elevational view of a motor-driven water lifting device in accordance with the present invention.
Figure 2:
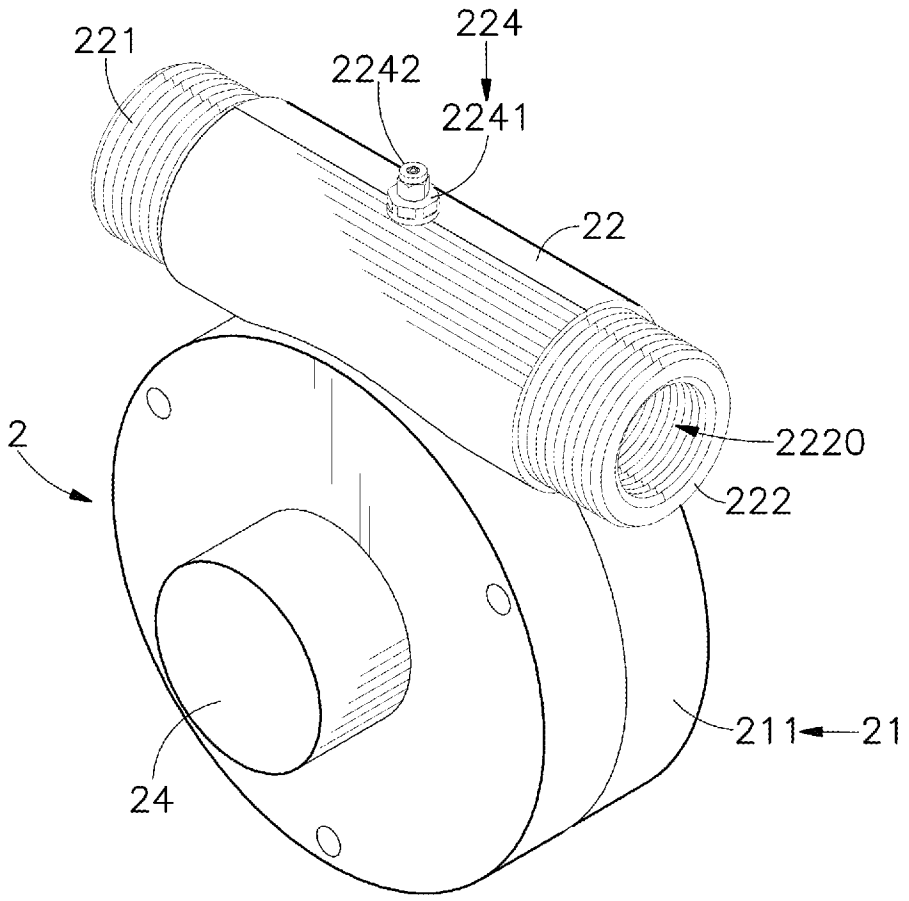
FIG. 2 is an elevational view of the water lifting device of the motor-driven water lifting device in accordance with the present invention.
Figure 3:
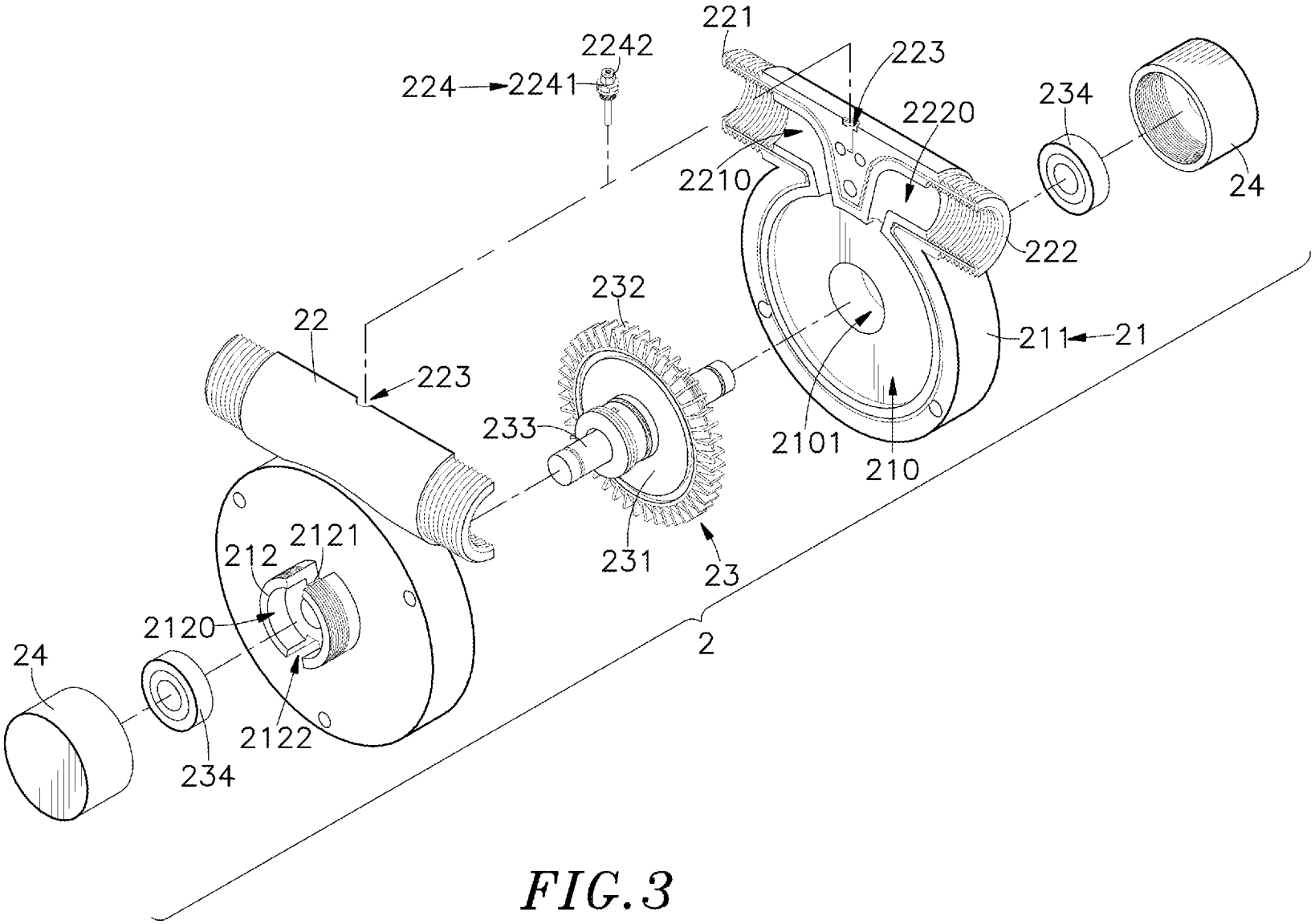
FIG. 3 is an exploded view of the water lifting device.
Figure 4:
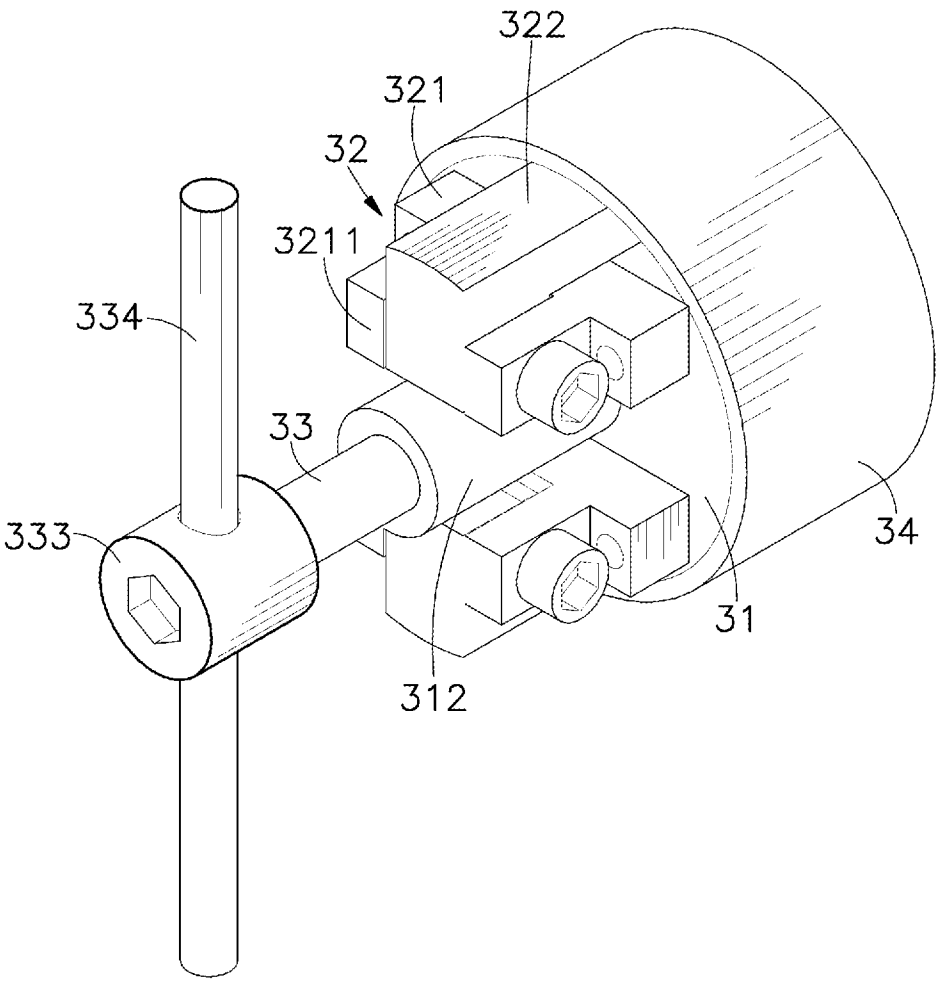
FIG. 4 is an oblique top elevational view of the levering device.
Figure 5:
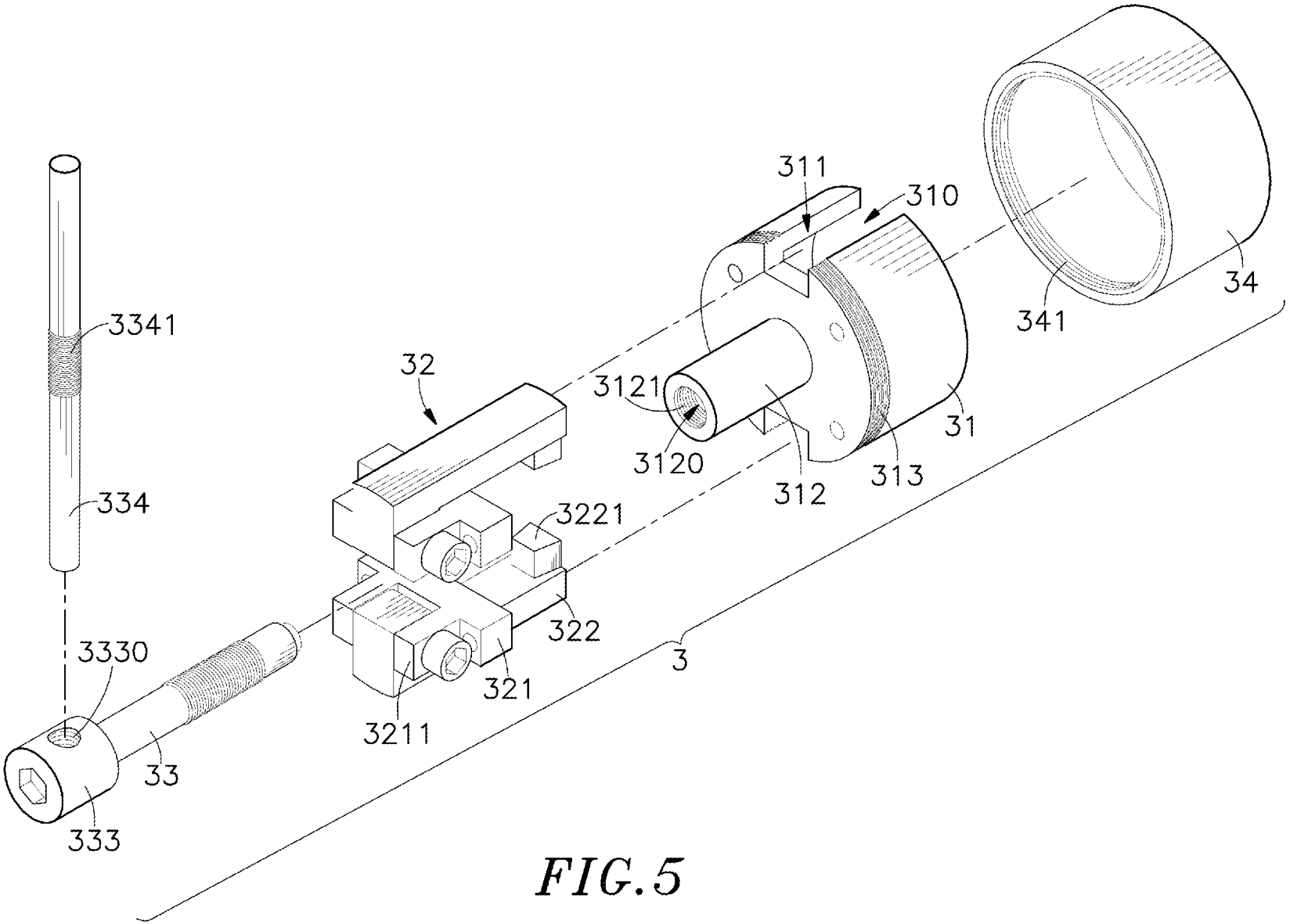
FIG. 5 is an exploded view of the levering device.
Figure 6:
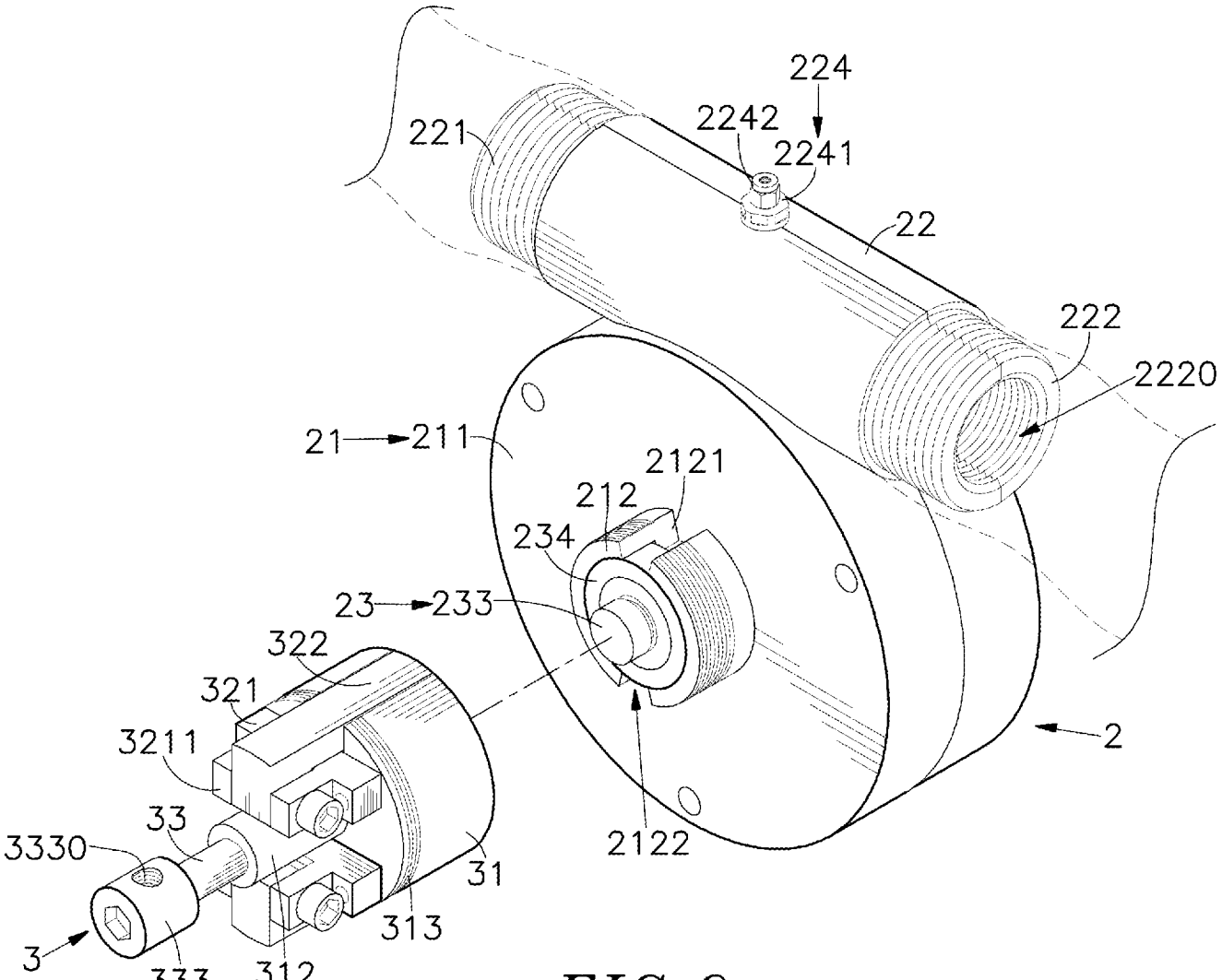
FIG. 6 is an exploded view of a part of the present invention, showing the relationship between the levering device and the water lifting device.
Figure 7:
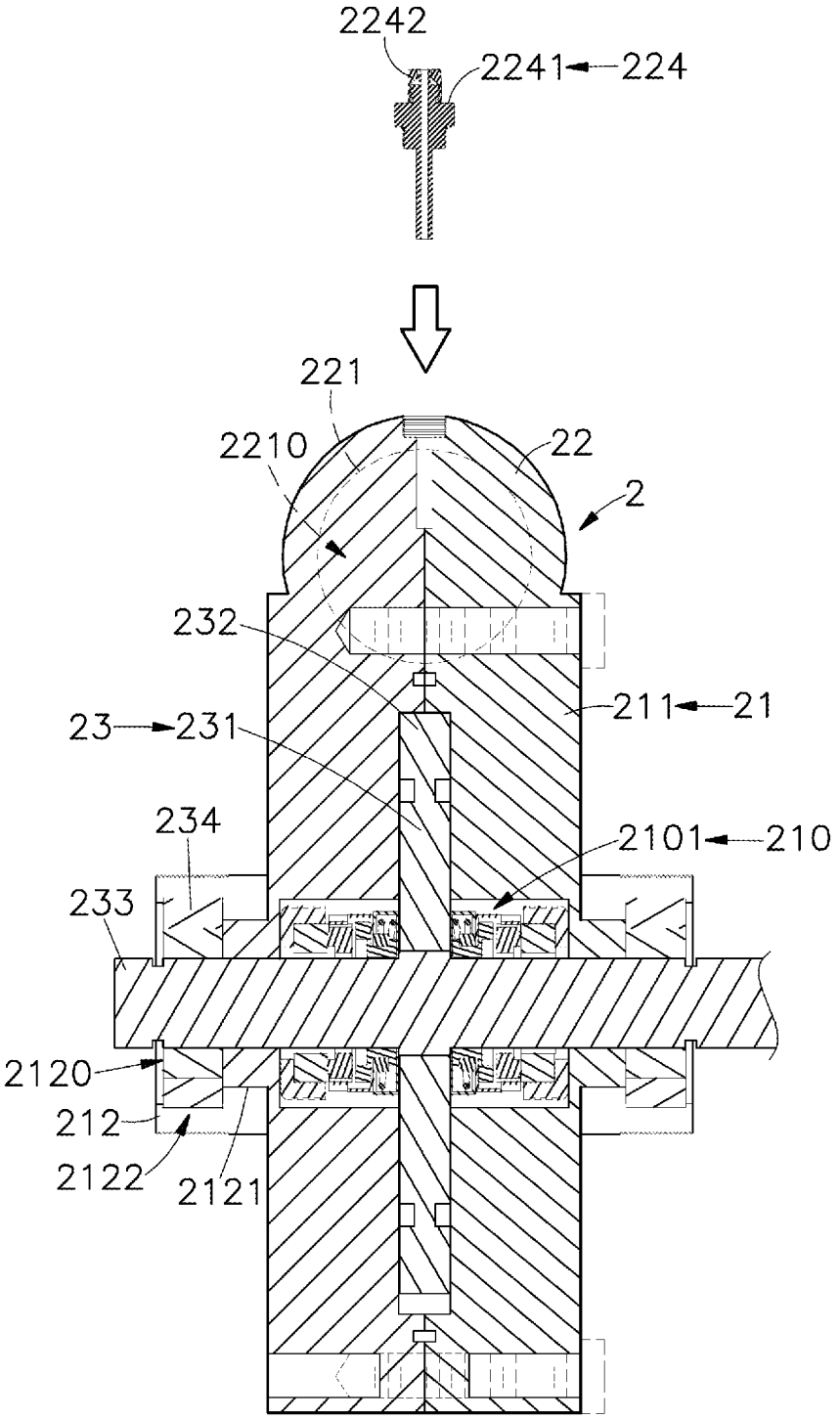
FIG. 7 is a schematic sectional view of the present invention, illustrating the installation of the air valve in the water lifting device.
Figure 8:
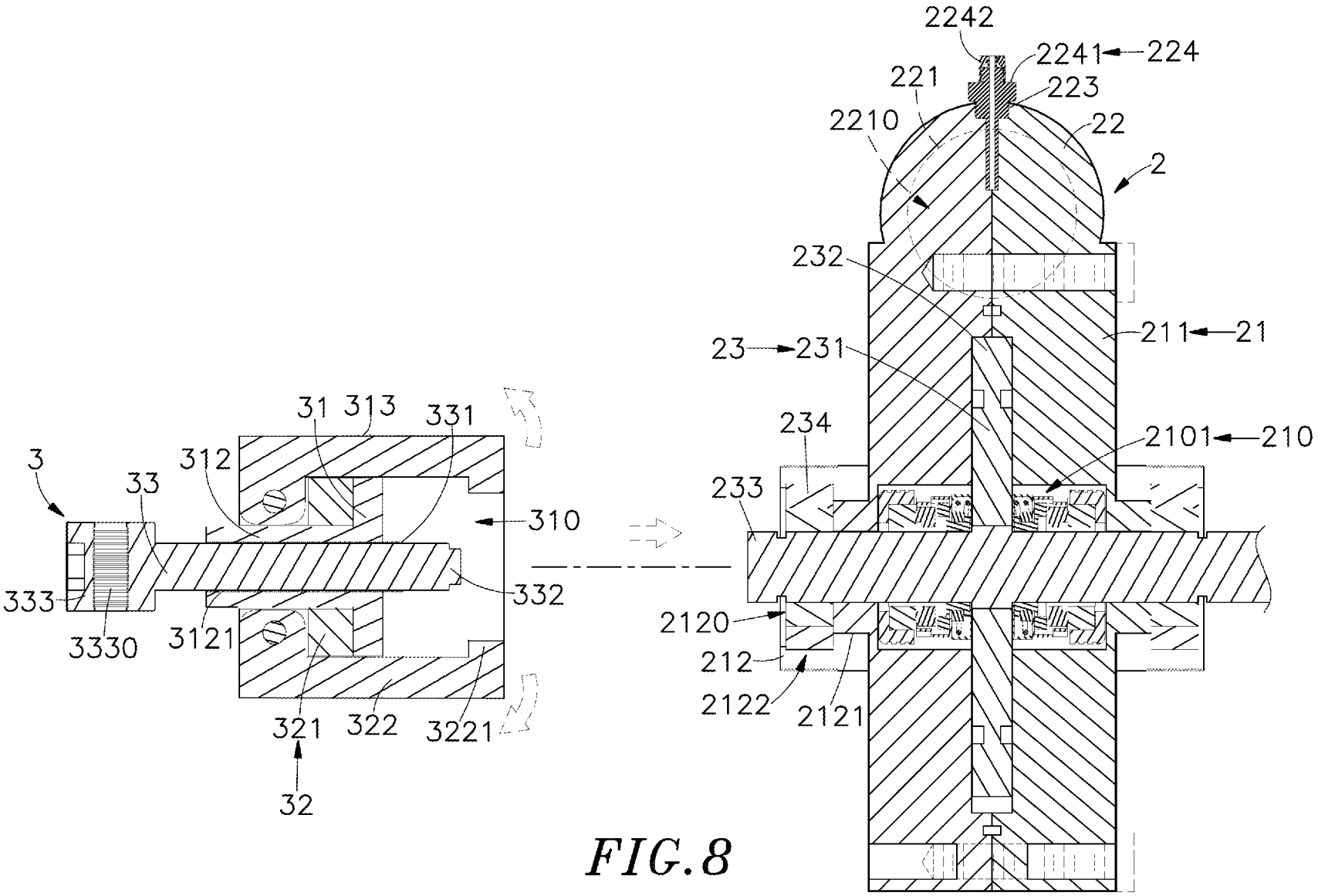
FIG. 8 is schematic sectional view showing an axle bearing dismounting operation of the present invention (I).
Figure 9:
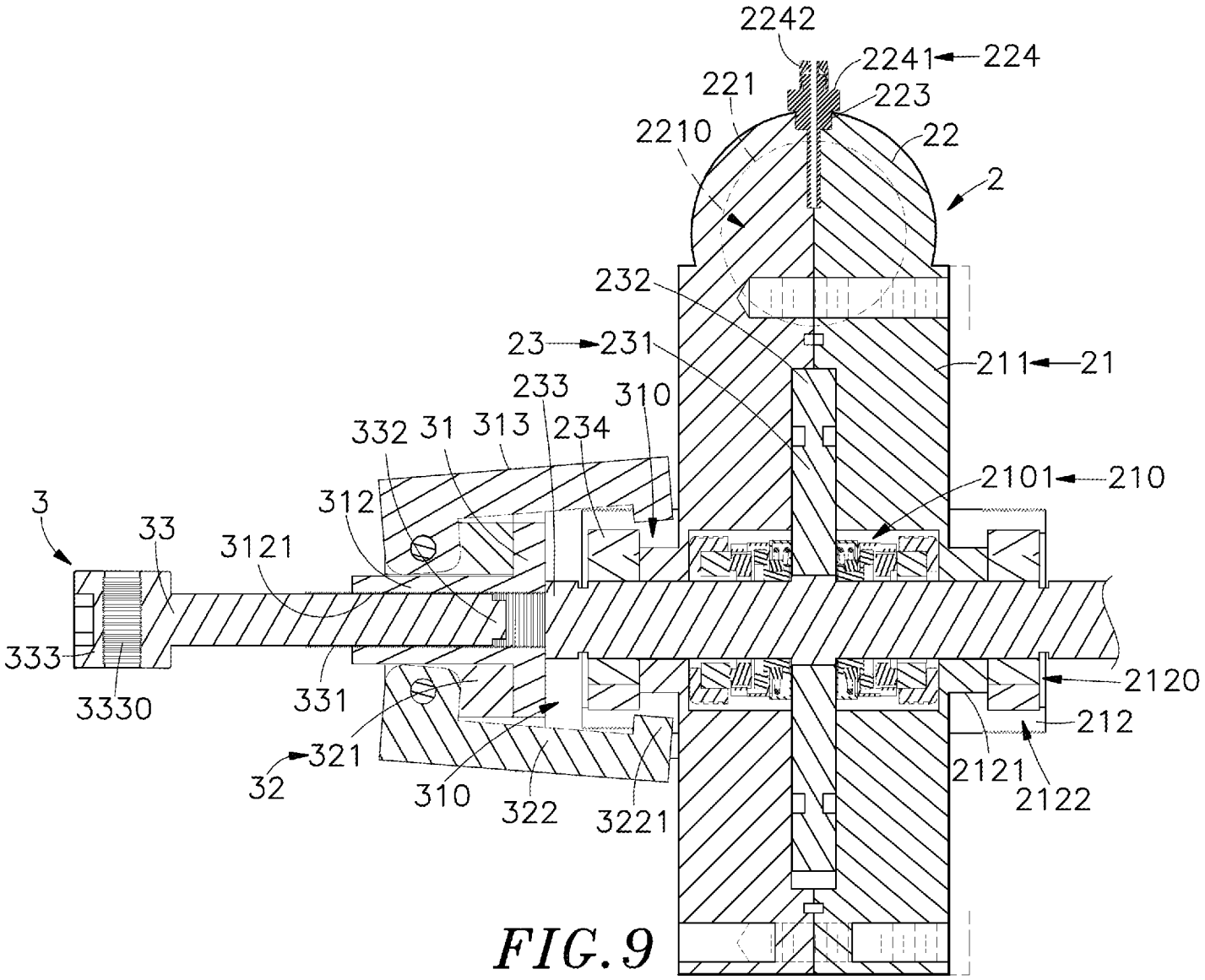
FIG. 9 is schematic sectional view showing an axle bearing dismounting operation of the present invention (II).
Figure 10:
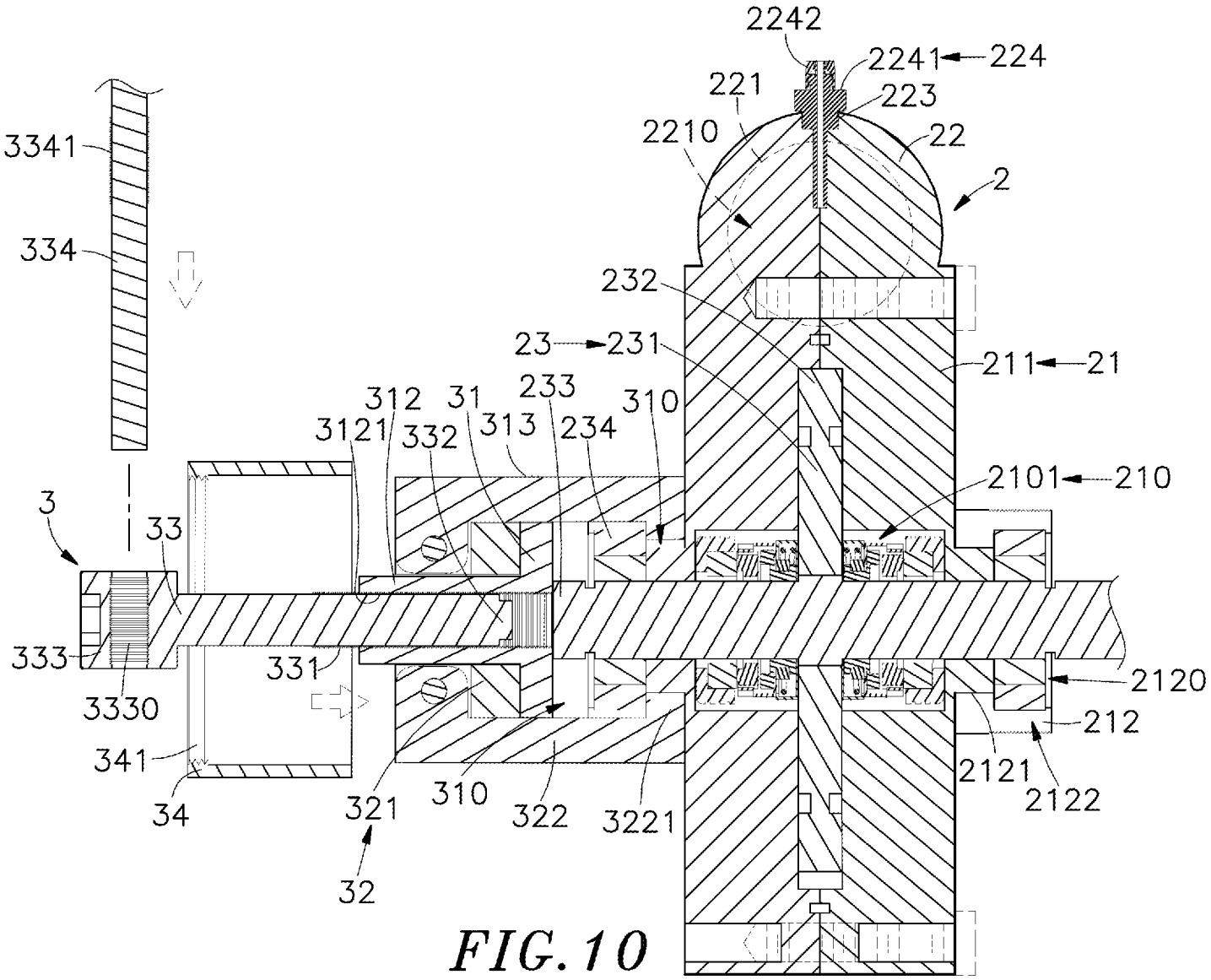
FIG. 10 is schematic sectional view showing an axle bearing dismounting operation of the present invention (III).
Figure 11:
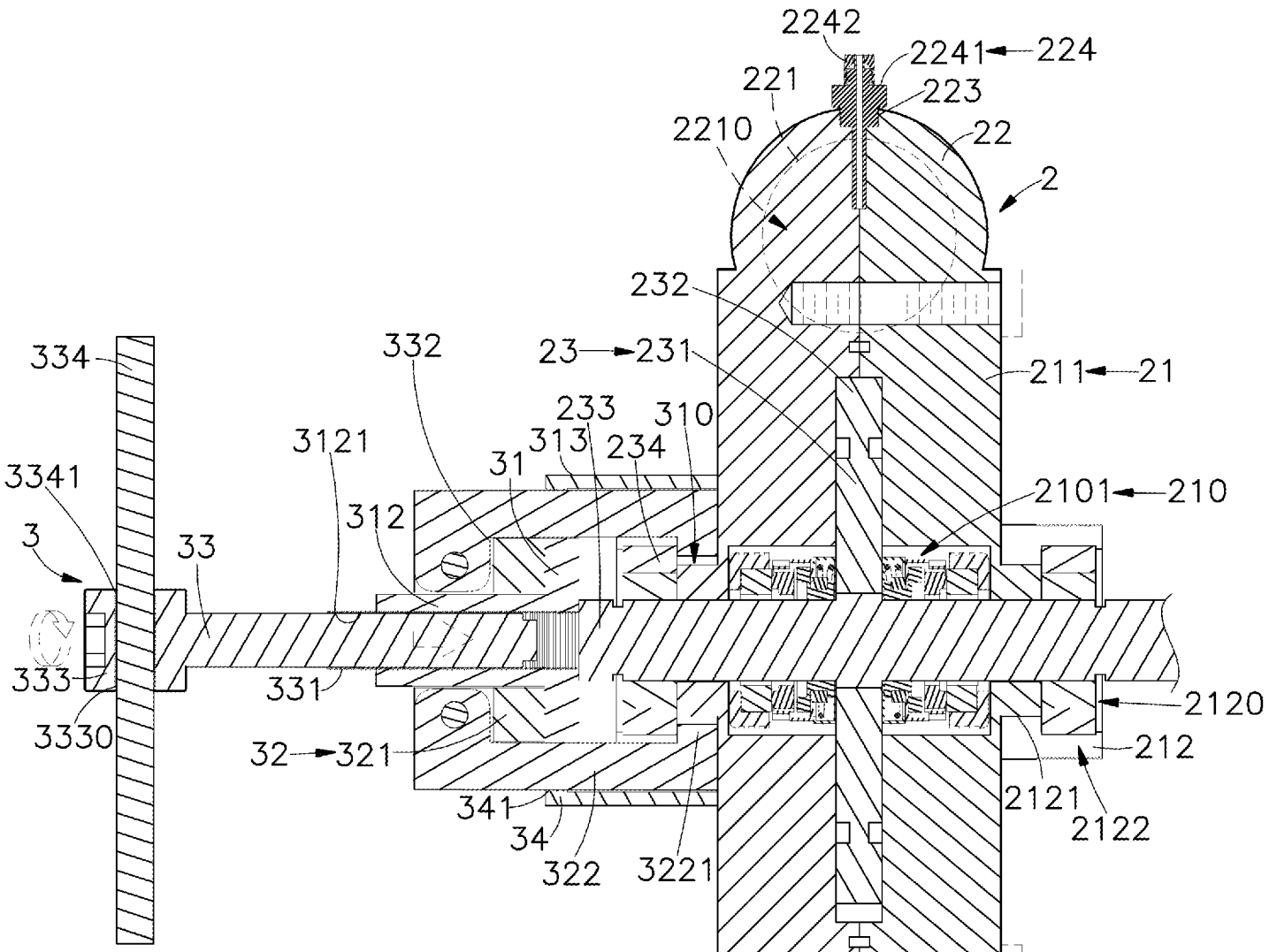
FIG. 11 is schematic sectional view showing an axle bearing dismounting operation of the present invention (IV).
Figure 12:
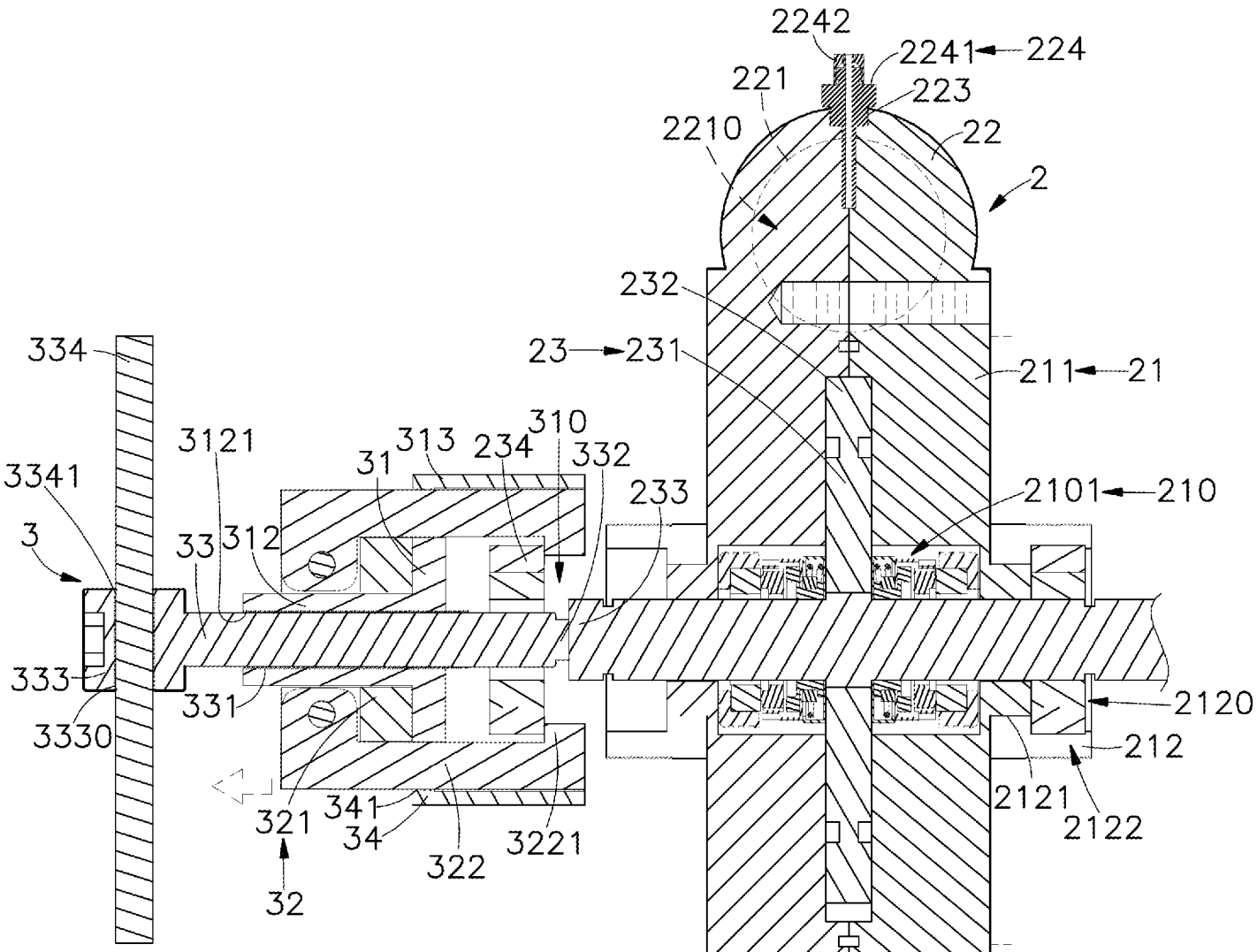
FIG. 12 is schematic sectional view showing an axle bearing dismounting operation of the present invention (V).

Referring to FIG. 1, a motor-driven water lifting device generally comprises a motor 1, a water lifting device 2 and a levering device 3. The detailed explanation of each component is as follows:

The motor 1 is used for lifting and delivering water, having one side thereof connected to the water lifting device 2.

The water lifting device 2 comprises a housing 21, a water supply pipe 22, a water-lifting wheel 23 and two protective caps 24. The detailed explanation of each component of the water lifting device 2 is as follows:

The housing 21 defines therein an accommodation chamber 210 that accommodates the water-lifting wheel 23. The housing 21 is composed of two shells 211. The two shells 211 each comprise an axle hole 2101 at the center in communication with the accommodation chamber 210, two arched bearing holder plates 212 protruded from an outer surface thereof around the axle hole 2101, a bearing chamber 2120 defined in the outer surface between the two arched bearing holder plates 212 and disposed in communication with the accommodation chamber 210 through the axle hole 2101, and two channels 2122 defined between the two arched bearing holder plates 212 at two opposite sides.

The two protective caps 24 are respectively fastened to the arched bearing holder plates 212 of the two shells 211 of the housing 21. The water-lifting wheel 23 comprises a wheel body 231, a plurality of vanes 232 spaced around the periphery of the wheel body 231, a wheel axle 233 located at the center of the wheel body 231 and axially extended out of two opposite sides of the wheel body 231, and at least one, for example, one axle bearing 234 mounted on each of the two opposite ends of the wheel axle 233 and respectively accommodated in the bearing chamber 2120 in between the two arched bearing holder plates 212 at each of the two opposite sides of the housing 21.

The water supply pipe 22 is disposed on the periphery of the housing 21 at one side, comprising a water inlet connection portion 221, a water outlet connection portion 222, a water inlet 2210 defined in the water inlet connection portion 221 for guiding water into the accommodation chamber 210, a water outlet 2220 defined in the water outlet connection portion 222 for guiding water out of the accommodation chamber 210.

The water supply pipe 22 further comprises an air inlet hole 223 for supplying an external gas into the accommodation chamber 210 of the housing 21, so that the intake gas can mix with the flowing water in the accommodation chamber 210 and sufficiently agitated by the water-lifting wheel 23 to form a bubble water. The external gas can be air, carbon dioxide, hydrogen, oxygen or ozone gas. The water supply pipe 22 further comprises an air valve 224 threaded into the air inlet hole 223. The air valve 224 comprises a valve body 2241 having a gas passage therein (not shown), and a nut 2242 threaded onto the top end of the valve body 2241. Further, a gasket (not shown) is provided between the air valve 224 and the air inlet hole 223 to prevent bubble water leakage from the accommodation chamber 210. The air valve 224 is to be connected to an external gas source (not shown) so that an external gas (air, carbon dioxide, hydrogen, oxygen or ozone gas) can be filled into the air valve 224.

The above various gas mixed waters are described in the field of application of bubble water as follows: if air or oxygen ($O_2$) is added with water, the bubble water can be applied to the wastewater treatment pressure floating method, generating negative ions or increasing the gas content in the water. If ozone ($O_3$) is added with water, the bubble water can be used for food cleaning, sterilization, disinfection, decomposition of pesticides, semiconductor panel or wafer cleaning. If the carbon dioxide ($CO_2$) is added with water, the bubble water can be applied to seaweed culture, nano calcium carbonate coating, replacing carbon capture and storage. If hydrogen ($H_2$) is added with water, the bubble water can be applied to the oxidation-reduction potential of water with a negative redox value and negative hydrogen ion water.

The levering device 3 is used to be attached to the arched bearing holder plates 212 at one of the two opposite sides of the housing 21 to remove the respective axle bearing 234 from the wheel axle 233. The levering device 3 comprises a coupling block 31, a gripper 32, an operating rod 33 and a constraint sleeve 34. The coupling block 31 is attachable to the arched bearing holder plates 212 at one side of the housing 21, comprising a coupling chamber 310 for receiving the arched bearing holder plates 212 at one side of the housing 21, two guide slots 311 cut through the peripheral wall thereof in communication with the coupling chamber 310 and respectively disposed corresponding to the channels 2122 between the two arched bearing holder plates 212, an extension rod 312 axially extended from one side thereof opposite to the accommodation chamber 210, and an axial hole 3120 axially cut through the extension rod 312 in communication with the coupling chamber 310. The operating rod 33 is axially movably inserted through the axial hole 3120 into the bearing chamber 2120 to stop against the respective one end of the wheel axle 233. The gripper 32 is attachable to the two guide slots 311 of the coupling block 31, comprising two gripper blocks 321 respectively disposed at two opposite sides relative to the extension rod 312 of the coupling block 31 outside the guide slots 311 and providing a respective pivot connection portion 3211, and two claw bars 322 respectively pivotally connected to the pivot connection portions 3211 of the gripper blocks 321 and respectively terminating in a claw 3221 for catching the axle bearing 234. The constraint sleeve 34 is sleeved onto the coupling block 31 to stop the two claw bars 322 in the respective guide slots 311.

As described above, the axle bearings 234 are respectively mounted on the two opposite ends of the wheel axle 233 and accommodated in the bearing chambers 2120 in between the respective arched bearing holder plates 212 at each of the two opposite sides of the housing 21. Further, buckle grooves 2121 are respectively defined between the axle bearing 234 and the channels 2122 for the entering of the claws 3221 of the gripper 32 of the levering device 3.

Further, an outer thread 313 and an inner thread 341 are respectively formed on the outer perimeter of the coupling block 31 and the inner perimeter of the constraint sleeve 34. Further, the operating rod 33 is detachably mounted in the extension rod 312. The extension rod 312 has a female thread 3121 spirally extended in the axial hole 3120. The operating rod 33 has male thread 331 spirally extended spirally extended around the periphery thereof for threading into the female thread 3121 in the axial hole 3120, a push portion 332 located at one end thereof and movable with the operating rod 33 into the coupling chamber 310 in the coupling block 31, a head 333 located at an opposite end thereof, a screw hole 3330 transversely formed in the head 333, and a handle 334 fastened to the head 333. The handle 334 has a screw rod portion 3341 for threading into the screw hole 3330 in the head 333 so that the handle 334 can be operated to rotate the head 333 and the operating rod 33. Further, the constraint sleeve 34 is attached onto the coupling block 31 by threading the inner thread 341 of the constraint sleeve 34 onto the outer thread 313 of the coupling block 31, allowing the constraint sleeve 34 to be rotated and axially moved relative to the coupling block 31.

As described above, the two gripper blocks 321 of the gripper 32 of the levering device 3 are disposed at two opposite sides relative to the extension rod 312, and the claw bars 322 are respectively pivotally connected to the pivot connection portions 3211 of the gripper blocks 321 with the claws 3221 inserted into the respective buckle grooves 2121 to catch the axle bearing 234.

In summary, as illustrated in FIGS. 1-12, the invention provides a motor-driven water lifting device, which comprises a motor and a water lifting device connected to the motor. The water lifting device comprises a housing consisting of two shells with an accommodation chamber defined therein, a water-lifting wheel mounted in the accommodation chamber, a water supply pipe disposed at the periphery of the housing and having a water inlet for guiding water into the accommodation chamber and a water outlet for guiding water out of the accommodation chamber, and an air inlet hole located on the water supply pipe for allowing an external gas such as air, carbon dioxide, hydrogen, oxygen or ozone gas to be filled into the accommodation chamber of the housing so that when water is guided through the water inlet into the accommodation chamber, the intake water is agitated by the water-lifting wheel and mixed with the external gas in the accommodation chamber to form a bubble water. The water molecules of the bubble water are finely mixed by mixing with the gas, and the fine bubble water is suitable for cleaning various objects to achieve an optimized cleaning effect.

Further, the fine bubble water can be applied to the cleaning of various fields and various objects, such as: business travel home life, agricultural planting, aquaculture, animal husbandry, industrial equipment cleaning, sewage treatment purposes. Further, as described above, the housing is composed of two shells, each shell comprising an axle hole at the center in communication with the accommodation chamber, two arched bearing holder plates protruded from an outer surface thereof, a bearing chamber defined in the outer surface between the two arched bearing holder plates and two channels defined between the two arched bearing holder plates at two opposite sides. Further, the water-lifting wheel comprises a wheel body, a plurality of vanes spaced around the periphery of the wheel body rotated with the wheel body to lift water out of the accommodation chamber through the water outlet of the water supply pipe, a wheel axle located at the center of said wheel body and axially extended out of two opposite sides of the wheel body and pivotally coupled to the axle holes of the shells of the housing, and a plurality of axle bearings respectively mounted on two opposite ends of the wheel axle and respectively accommodated in the bearing chambers of the housing. This arrangement facilitates removal of the axle bearings for replacement or repair to extend the lifespan of the motor. The design of the air inlet hole of the water lifting device allows an external gas to be filled into the accommodation chamber to mix with the intake water so that a bubble water can be produced for cleaning foods and other various objects. The production of fine bubble water for food cleaning has great business opportunities in the healthy eating market, so the present application is filed for patent to seek patent protection.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A levering device for use to remove axle bearings from a wheel axle of a motor-driven water lifting device, said water lifting device comprising a housing including an accommodation chamber, said levering device comprising:

a coupling block;

a gripper;

an operating rod; and a constraint sleeve, said coupling block being attachable to arched bearing holder plates at one side of said housing of the motor-driven water lifting device, said coupling block comprising:

a coupling chamber for receiving said arched bearing holder plates at one side of said housing, two guide slots cut through a peripheral wall thereof in communication with said coupling chamber and respectively disposed corresponding to channels between said two arched bearing holder plates at one side of said housing, an extension rod axially extended from one side thereof opposite to said accommodation chamber, and an axial hole axially cut through said extension rod in communication with said coupling chamber, said operating rod being axially movably inserted through said axial hole into a bearing chamber of the housing to stop against respective one end of said wheel axle, said gripper being attachable to said two guide slots of said coupling block, said gripper comprising two gripper blocks respectively disposed at two opposite sides relative to said extension rod of said coupling block outside said guide slots and two claw bars respectively connected to said gripper blocks and respectively terminating in a claw for catching said axle bearings, and said constraint sleeve being sleeved onto said coupling block to stop said two claw bars in the respective said guide slots.

2. The motor-driven water lifting device as claimed in claim 1, wherein said coupling block comprises an outer thread; said constraint sleeve comprises an inner thread threaded onto said outer thread of said coupling block; said extension rod of said coupling block comprises a female thread spirally disposed in said axial hole; said operating rod comprises a male thread spirally extended around the periphery of one end thereof and threaded into said female thread of said extension rod of said coupling block, a head located at an opposite end thereof, and a handle fastened to said head.

3. The motor-driven water lifting device as claimed in claim 1, wherein said gripper blocks of said gripper each comprise a pivot connection portion; said two claw bars are respectively pivotally connected to said pivot connection portions of said gripper blocks, said claw bars pivot on said pivot connection portions.

* * * * *